US005511995A

United States Patent [19]

Cheng

[11] Patent Number: 5,511,995

[45] Date of Patent: Apr. 30, 1996

[54] DIRECT CURRENT CONNECTOR

[76] Inventor: Yu F. Cheng, No. 7, Fu Hsing St., Tu Cheng Hsiang, Taipei Hsien, Taiwan

[21] Appl. No.: 331,967

[22] Filed: Oct. 31, 1994

[51] Int. Cl.[6] ..... H01R 25/00

[52] U.S. Cl. ..... 439/638; 439/224

[58] Field of Search ..... 439/638, 224

[56] References Cited

U.S. PATENT DOCUMENTS

| | | | |
|---|---|---|---|
| 3,907,393 | 9/1975 | Ludwig | 439/638 OR |
| 4,621,600 | 6/1987 | Sawai et al. | 439/224 X |
| 4,648,682 | 3/1987 | Tubbs | 439/638 X |

*Primary Examiner*—Neil Abrams
*Assistant Examiner*—Daniel Wittels
*Attorney, Agent, or Firm*—Ralph F. Crandall; Holland & Hart

[57] ABSTRACT

A connector includes a joint including a hollow plug with a first electrode formed on an internal surface and a second electrode formed on an external surface. The joint is connected with a transformer. A first housing defines a first hole, a second hole and a third hole for receiving the hollow plug of the joint. A first plug with a first electrode and a second electrode is insertable through the first hole defined in the first housing. A second plug with a first electrode and a second electrode is insertable through the second hole defined in the first housing. A metal pin is connected with the first electrodes of the first and second plugs. A first J-shaped metal strip includes a first end portion connected with the second electrode of the first plug and a second end portion engageable with the second electrode of the plug of the joint. A second J-shaped metal strip includes a first end portion connected with the second electrode of the second plug and a second end portion engageable with the second electrode of the plug of the joint. A second housing defines a first hole, a second hole, a third hole and a fourth hole. The first housing is slidably receivable in the second housing. Either the first plug is insertable through the first hole defined in the second housing or the second plug is insertable through the second hole defined in the second housing. The hole defined in the first housing is in communication with either the third hole or the fourth hole defined in the second housing.

3 Claims, 3 Drawing Sheets

DIRECT CURRENT CONNECTOR

BACKGROUND OF THE INVENTION

This invention relates to a direct current connector.

There are many electric appliances consuming low-voltage direct currents. Dry batteries are used as power supplies or alternatively transformers are used for adjusting high voltages of mains power supplies to low voltages useful for such electric appliances. Each of the transformers includes at least one plug for engaging with a socket of one of the electric appliances. Many of the transformers each include four plugs for matching various sockets of the electric appliances. However, the plugs might be shorted unintentionally, thus causing damage to the electric appliances.

SUMMARY OF THE INVENTION

It is the primary objective of this invention to provide a direct current connector including a plurality of plugs which will not be short-circuited.

The connector includes a joint including a hollow plug with a first electrode formed on an internal surface and a second electrode formed on an external surface. The joint is connected with a transformer. A first housing defines a first hole, a second hole and a third hole for receiving the hollow plug of the joint. A first plug with a first electrode and a second electrode is insertable through the first hole defined in the first housing. A second plug with a first electrode and a second electrode is insertable through the second hole defined in the first housing. A metal pin is connected with the first electrodes of the first and second plugs. A first J-shaped metal strip includes a first end portion connected with the second electrode of the first plug and a second end portion engageable with the second electrode of the plug of the joint. A second J-shaped metal strip includes a first end portion connected with the second electrode of the second plug and a second end portion engageable with the second electrode of the plug of the joint. A second housing defines a first hole, a second hole, a third hole and a fourth hole. The first housing is slidably receivable in the second housing. Either the first plug is insertable through the first hole defined in the second housing or the second plug is insertable through the second hole defined in the second housing. The hole defined in the first housing is in communication with either the third hole or the fourth hole defined in the second housing.

DETAILED DESCRIPTION OF THE PREFERRED EMBODIMENT

Figure 1:
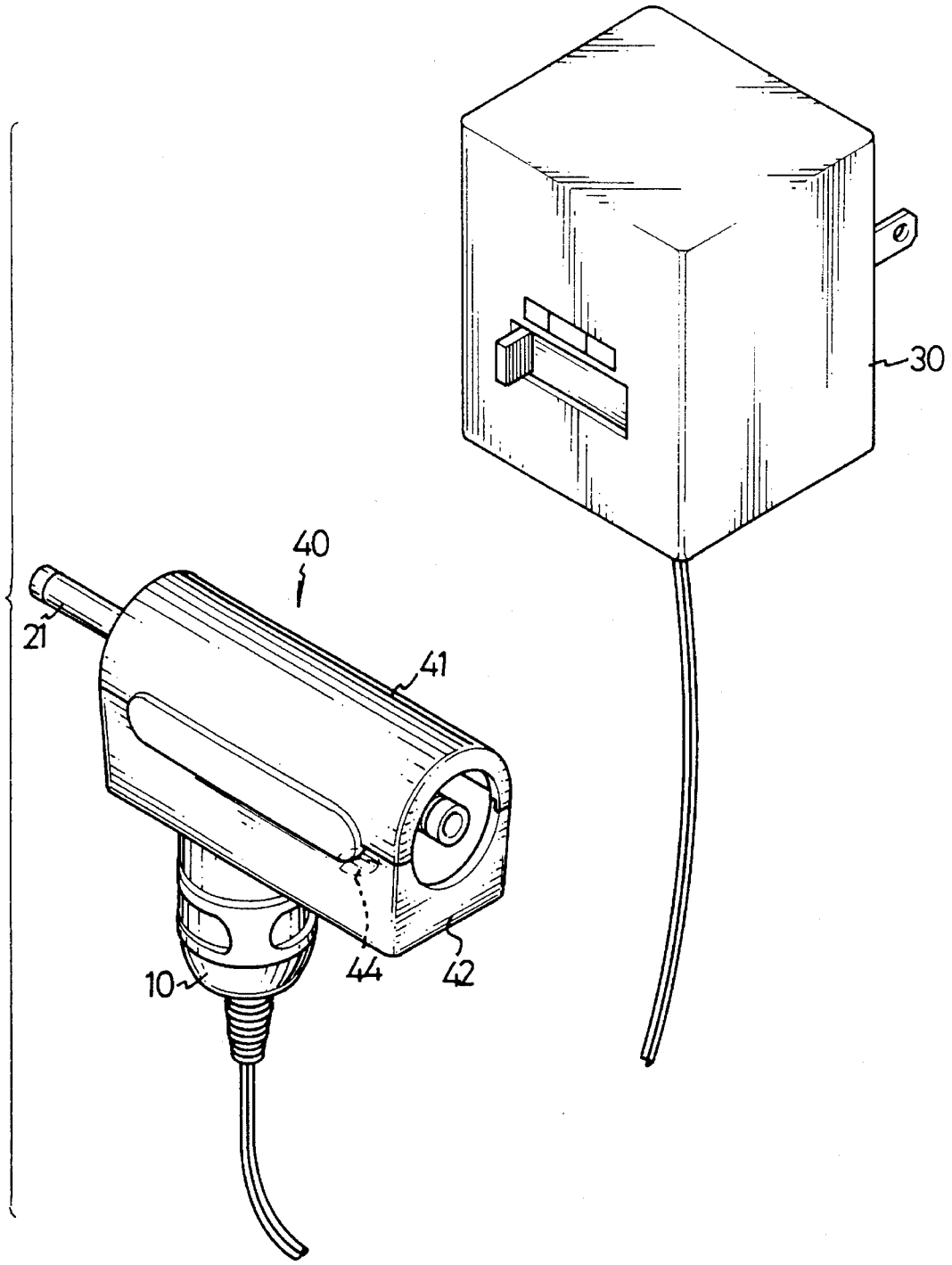
FIG. 1 is an isometric view of the preferred embodiment of a DC connector according to this invention.

Referring to FIG. 1, a transformer 30 is electrically connected with a direct current (DC) connector by means of a pair of wires (not numbered). The transformer 30 includes two plugs (only one is shown) engageable with two sockets of a mains power supply system. The transformer 30 is identical to many transformers in function, and is similar to many known transformers in configuration and, therefore, will not be described in detail. The connector is electrically connectable with a corresponding electrical appliance. Alternating current transmitted from the mains power supply is transformed to a direct current of a desired voltage in the transformer 30. The direct current of the desired voltage is transmitted to the electrical appliance through the connector.

Figure 2:
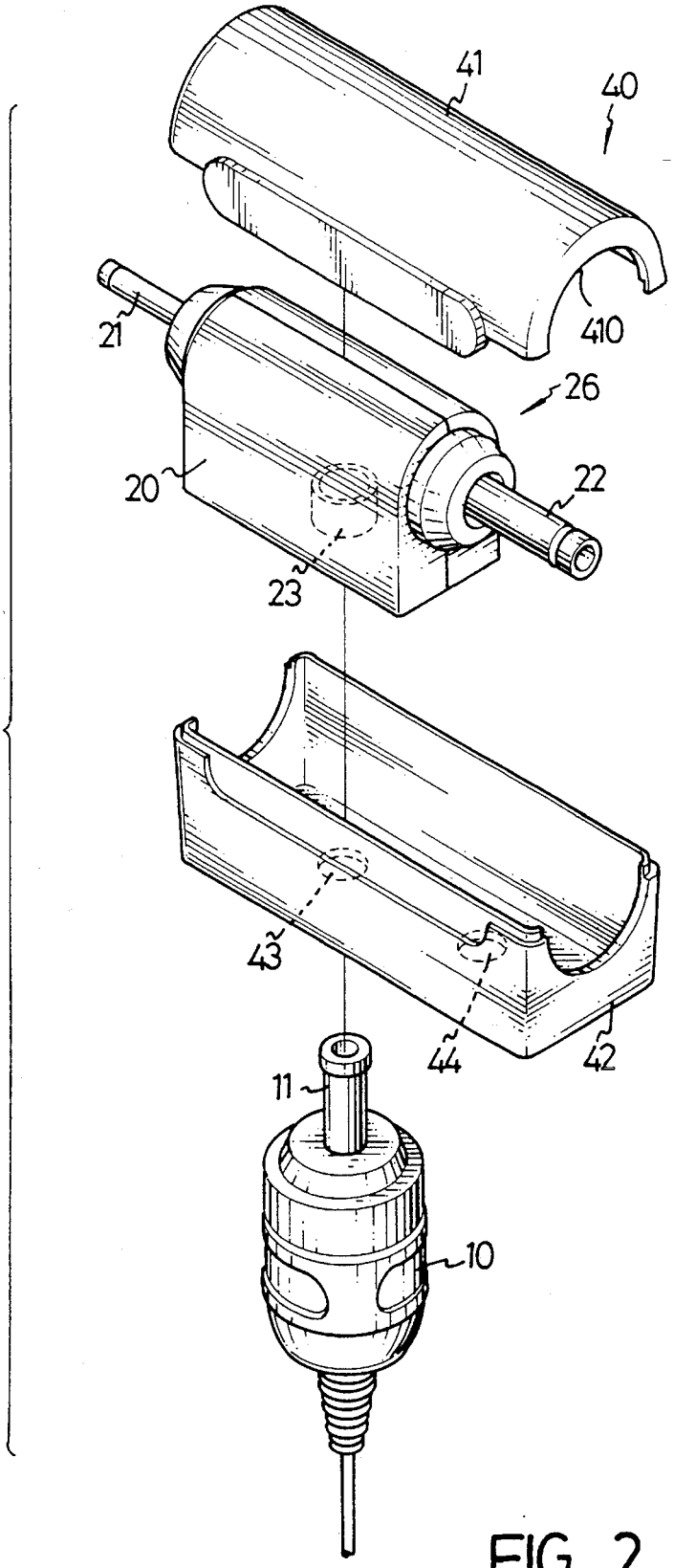
FIG. 2 is an exploded view of the DC connector as shown in FIG. 1.

Referring to FIG. 2, the connector includes a single-plug joint 10 electrically connectable with a dual-plug joint 20.

The single-plug joint 10 includes a single hollow plug 11. The single-plug joint 10 is identical to many known single-plug joints in function and, therefore, will not be described in detail.

The dual-plug joint 20 includes a solid plug 21 projecting from an end portion of a first housing 26 and a hollow plug 22 projecting from an opposed end portion of the first housing 26. The first housing 26 is assembled from two shells (not numbered). The first housing 26 defines a first hole (not numbered) in an end portion, a second hole (not numbered) in the remaining end portion and a third hole 23 in a lower portion. The plug 21 is insertable through the first hole defined in the first housing 26. The plug 22 is insertable through the second hole defined in the first housing 26.

Figure 3:
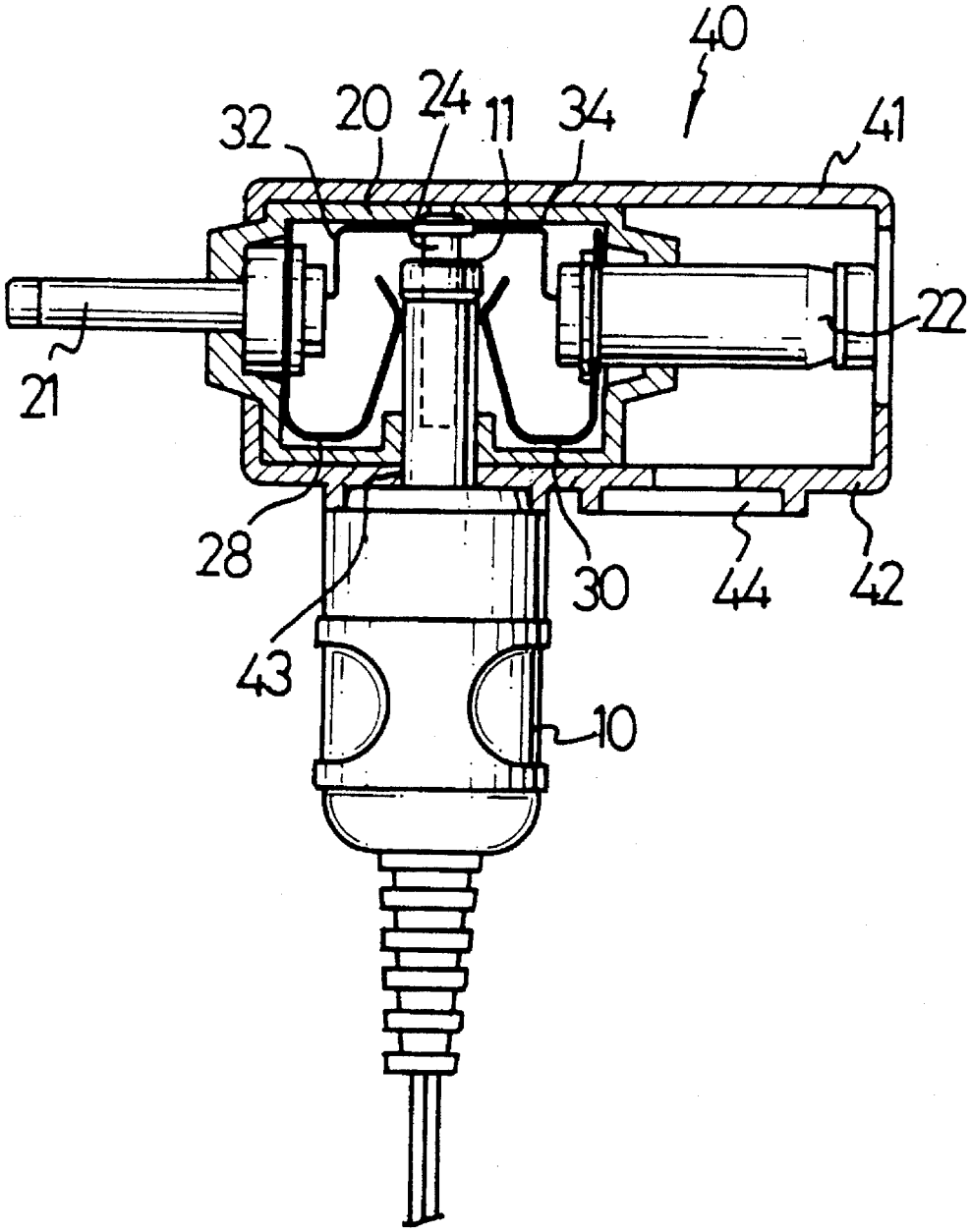
FIG. 3 is a cross-sectional view of the DC connector as shown in FIG. 2.

Referring to FIG. 3, a metal pin 24 is received in the first housing 26 between the plugs 21 and 22. A first electrode of the solid plug 21 is electrically connected with the metal pin 24 by means of a metal strip 32. A first electrode of the hollow plug 22 is electrically connected with the metal pin 24 by means of a metal strip 34. A second electrode of the solid plug 21 is electrically connected with a first end portion of a J-shaped metal strip 28. A first electrode of the hollow plug 22 is electrically connected with a first end portion of a J-shaped metal strip 30.

The hollow plug 11 is insertable through the hole 23. The first electrode of the hollow plug 11 is engageable with the metal pin 24. The second electrode of the hollow plug 11 is engageable with the second end portions of the J-shaped metal strips 28 and 30.

The plugs 21 and 22 and the first housing 26 are slidably received in a second housing 40 assembled from an upper shell 41 including two end portions each defining a cutout 46 and a lower shell 42 including two end portions each defining a cutout 48 so that the second housing 40 defines two holes. The plugs 21 and 22 and the first housing 26 are slidable relative to the second housing 40 so that either of the solid plug 21 or the hollow plug 22 is selectively insertable through a corresponding one of the holes defined in the second housing 40.

I claim:

1. A direct current connector comprising:

a joint including a hollow plug with a first electrode formed on an internal surface and a second electrode formed on an external surface, wherein the joint is connected with a transformer;

a first housing defining a first hole, a second hole and a third hole for receiving the hollow plug of the joint;

a first plug including a first electrode and a second electrode, wherein the first plug is insertable through the first hole defined in the first housing;

a second plug including a first electrode and a second electrode, wherein a second plug is insertable through the second hole defined in the first housing;

a metal pin connected with the first electrodes of the first and second plugs;

a first J-shaped metal strip including a first end portion connected with the second electrode of the first plug and a second end portion engageable with the second electrode of the plug of the joint;

a second J-shaped metal strip includes a first end portion connected with the second electrode of the second plug and a second end portion engageable with the second electrode of the plug of the joint; and a second housing defining a first hole, a second hole, a third hole and a fourth hole wherein the first housing is slidably receivable in the second housing so that one of the first and second plugs is selectively insertable through one of the first and second holes defined in the second housing and that the hole defined in the first housing is selectively in communication with one of the third and fourth holes defined in the second housing.

2. A direct current connector according to claim 1 wherein the first housing includes two shells joined together.

3. A direct current connector according to claim 1 wherein the second housing includes two shells joined together.

* * * * *